US006769226B2

(12) United States Patent
Holland et al.

(10) Patent No.: US 6,769,226 B2
(45) Date of Patent: Aug. 3, 2004

(54) GELATIN ENCAPSULATION TECHNIQUES

(75) Inventors: Neil John Holland, Haydon Wick Swindon (GB); George Bernard Tidy, Swindon (GB)

(73) Assignee: Cardinal Health 409, Inc., St. Petersburg, FL (US)

( * ) Notice: Subject to any disclaimer, the term of this patent is extended or adjusted under 35 U.S.C. 154(b) by 70 days.

(21) Appl. No.: 09/381,336

(22) PCT Filed: Mar. 19, 1998

(86) PCT No.: PCT/GB98/00830

§ 371 (c)(1),
(2), (4) Date: Dec. 29, 1999

(87) PCT Pub. No.: WO98/42294

PCT Pub. Date: Oct. 1, 1998

(65) Prior Publication Data

US 2002/0026772 A1 Mar. 7, 2002

(51) Int. Cl.[7] ..... B65B 47/04; B65B 61/02

(52) U.S. Cl. ..... 53/411; 53/454; 53/64; 53/131.5; 53/389.4; 53/560

(58) Field of Search ..... 53/411, 454, 64, 53/131.5, 560, 389.4

(56) References Cited

U.S. PATENT DOCUMENTS

| | | | | |
|---|---|---|---|---|
| 2,234,479 A | | 3/1941 | Scherer | |
| 3,592,372 A | | 7/1971 | James | |
| 3,616,750 A | | 11/1971 | Gottscho | |
| 4,567,714 A | * | 2/1986 | Chasman | 53/560 |

FOREIGN PATENT DOCUMENTS

| | | |
|---|---|---|
| GB | 0758642 | 10/1956 |
| GB | 0782401 | 9/1957 |
| GB | 0920004 | 3/1963 |
| GB | 1923460 | 3/1970 |
| GB | 2016799 | 2/1971 |
| GB | 2706671 | 8/1978 |

* cited by examiner

*Primary Examiner*—John Sipos
(74) *Attorney, Agent, or Firm*—Donald O. Nickey

(57) ABSTRACT

A method and apparatus for producing filled gelatin capsules created from strips (4) of gelatin ribbon. The strips are led to an encapsulation station (6) where they are enclosed around the fill that is delivered thereto. Means are provided for controlling the lateral alignment of the strip in its path to the encapsulation station (6) preferably, such means comprises a pivotal guide bar assembly (52).

2 Claims, 5 Drawing Sheets

GELATIN ENCAPSULATION TECHNIQUES

This invention relates to the encapsulation of products within a gelatin shell derived from a ribbon thereof.

The encapsulation of a wide range of products in gelatin shells is long-established. The basic technique is described in U.S. Pat. No. 2,234,479, and it has of course been substantially developed since then. Nevertheless, modern encapsulation machinery still draws gelatin ribbon from two sources to a charging station where sections of gelatin strip from both ribbons are sealed around the respective contents. Encapsulation is normally accomplished using a flat or a roller dye technique. A typical roller dye technique is described in an article entitled "Soft gelatin capsules: a solution to many tableting problems" published in Pharmaceutical Technology in September 1985.

Gelatin capsules are normally made using soft gelatin and in its ribbon form prior to encapsulation it is highly flexible and deformable. Gelatin may be blended with other components to vary its characteristics in different ways for different applications. However, the term "gelatin" is used herein to encompass a range of gelatin based compositions which are used in encapsulation processes. Because of its flexibility and deformability, which are of course important advantages of gelatin, it tends to be very mobile as it is drawn to the encapsulation station from a source, normally the drum upon which it is cast. As a consequence, the speed at which a ribbon of gelatin can be drawn to the encapsulation station is severely limited. However, we have found that if the lateral alignment of the strip can be controlled, the ribbon may be drawn significantly more quickly to the encapsulation station, with a consequential increase in production speed. The lateral alignment of the strip can be controlled by use of sensing means for monitoring the alignment, with the sensing means being coupled to a computer which receives signals therefrom, and accordingly instructs the controlling means in response to such signals. Typically, there are pre-set limits of the alignment or misalignment of the strip, and the computer may be programmed to instruct the controlling means such that lateral misalignment of the strip is restricted to within those limits.

Lateral misalignment of a gelatin strip can be corrected in accordance with the present invention by providing for one or more support rollers in the path of a strip to the encapsulation station to be capable of shifting axially relative to the path. Using an alternative technique, this correction is achieved using an applicator guide assembly including a guide roller; sensing means for monitoring lateral movement of the strip on the guide roller; a locator roller mounted for rotation about a pivotal axis; and means for pivoting the locator roller relative to the guide roller to shift strip laterally thereon. The strip will normally pass between the guide and locator rollers. In the lateral shifting or correction of the strip using either of these techniques, the flexibility and deformability of the gelatin is of considerable assistance as it enables adjustment to be accomplished without difficulty and more importantly, without shutting down the apparatus itself.

The lateral movement or position of the strip can be monitored with reference to an edge of the strip, but because the edge of a gelatin strip can be irregular, in some preferred embodiments of the invention provision is made for the application of a longitudinal line adjacent the strip edge, with sensing means monitoring the position of that line. The line can be applied by a simple roller printer, and a line can be more easily monitored by some sensing systems.

Prior to the present invention, the speed at which a gelatin ribbon could safely be drawn into an encapsulation station was significantly restricted. Typical speeds are around 2.5 cm per second; these lower speeds being essential to prevent the migration of the gelatin strip along the axial length of guidance rollers out of alignment to such an extent that the full width thereof could not be used at the encapsulation station. However, by controlling the lateral movement and alignment of the strip in its path to the encapsulation station, we have found that significantly increased speeds can be used, subject of course, to any restrictions imposed by the manner in which the strip is created, normally by casting on a drum. Speeds of 7.5 cms/sec or more are contemplated. As a consequence, production rates can also be enhanced.

The method and the apparatus of the present invention are of particular value in processes in which some form of image is applied to one or both of the gelatin strips, which image is to appear on the eventual capsules. The lateral position of the gelatin strip is of course important when an image is to applied in a particular manner. An encapsulation method and apparatus in which an image is applied to a gelatin strip is described in an International Patent Application being filed today at the British Patent Office in our name and under our agents reference EH/42029. Reference is directed to that Application.

The invention will now be described by way of example, and with reference to the accompanying schematic drawings wherein.

Figure 1:
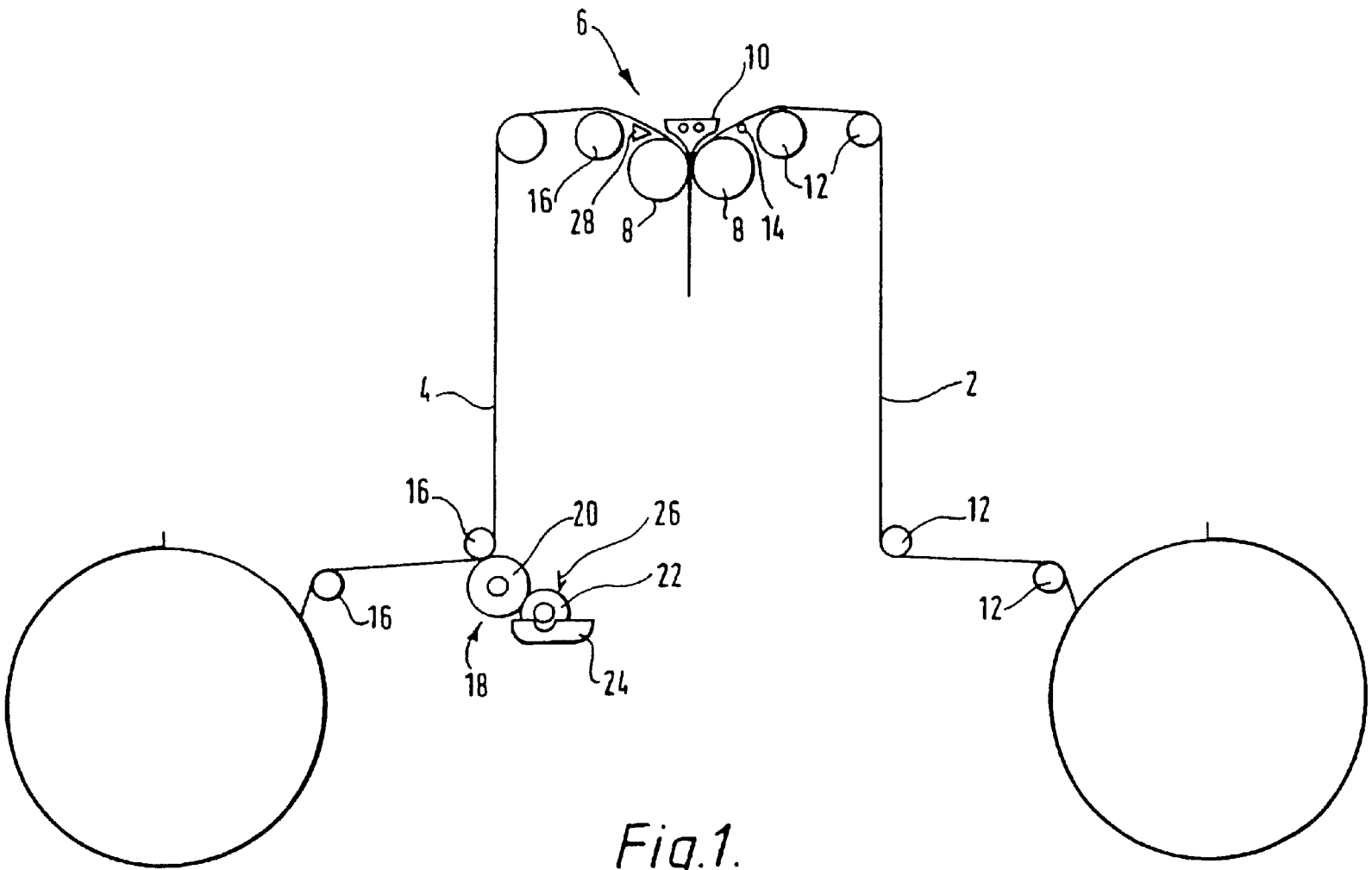
FIG. 1 is a representation of apparatus described in our International Application referred to above.

The apparatus diagrammatically illustrated in FIG. 1 shows the path of two gelatin ribbons 2, 4 from respective casting drums to an encapsulation station 6 comprising roller dyes 8 which combine with a fill mechanism (not shown) coupled to a wedge 10 to encapsulate fill material in a conventional manner. The ribbon 2 is carried to the encapsulation station 6 around rollers 12 and over a feed bar 14. The path of ribbon 4 is around rollers 16, and a sensing device 28. One of the rollers 16 is part of a transfer station 18 at which images are applied thereto from printing roller 20. Ink is applied to the printing roller 20 from transfer or inking roller 22 disposed over ink bath 24.

The roller dyes 8 at the encapsulation station 6 are formed with recesses which are in juxtaposition when they reach the nip and are filled. In order to properly locate images applied to the ribbon 4 on formed capsules, it is of course essential that the applied images properly register with the recesses.

The inking roller 22 has a screened or roughened surface comprising an array of pockets. A roller having a particular pocket density on its screened surface will be selected depending upon the ink that is being used and the required printing effect. As a general guide, larger pockets will be used for lighter colours where a greater quantity of ink must be transferred to ensure that the requisite image is created on the ribbon surface. Because of the retention of the ink in rather than on the surface of the inking roller 22, its surface can be scraped or wiped at the pocket peripheries with the retained ink being a predictable metered quantity. This enables the density of colour in the printed image to be accurately established, and by this means, a reliable quality of printing can be achieved.

As can be seen, the gelatin ribbon 4 bearing images transferred thereto from printing roller 20 is carried around to the encapsulation station 6 where the device 28 monitors the location of images on the ribbon relative to the recesses in the roller dye 8 in which the capsules will be formed. The device 28 is located such that the ribbon section and roller dye section that it scans are equidistant from the roller nip. Thus, it can immediately establish whether a printed image is in proper registry with a respective recess and if not, what correction is required. Signals generated by the scanning device 28 are transmitted to a control device (not shown) which adjusts the speed of the printing roller 20 as appropriate.

Figure 2:
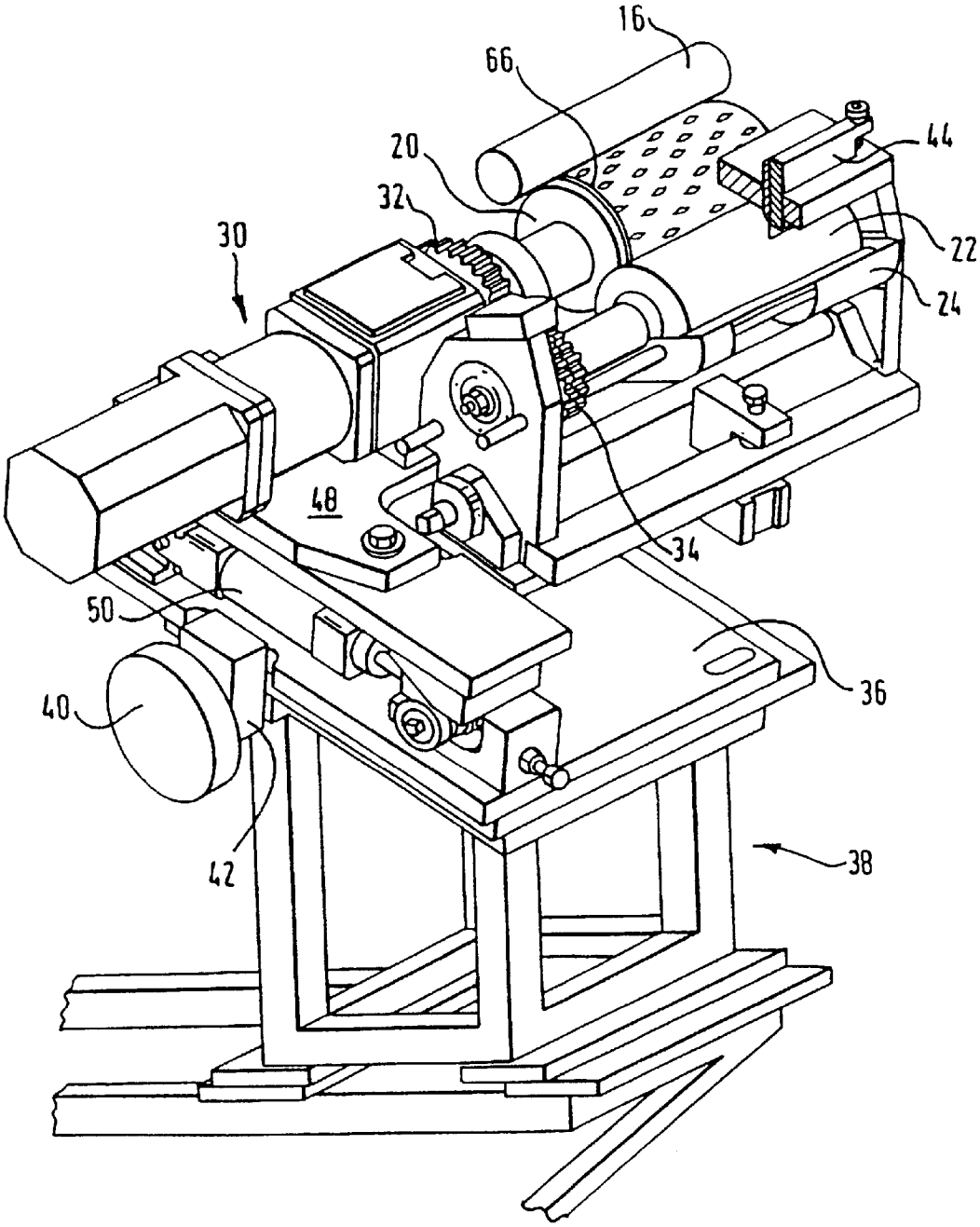
FIG. 2 is a perspective view showing a transfer station of the kind used in the apparatus of FIG. 1 and embodying the present invention.

The transfer station 18 is illustrated in more detail in FIG. 2. The print roller 20 is driven by a stepping motor 30. The shaft coupling the roller 20 to the motor 30 bears a gear wheel 32 which meshes with another wheel 34 which drives the inking roller 22. An encoder (not shown), typically mounted on one of the rollers 8 in the encapsulation station monitors the rotation of the rollers and thereby the location of the recesses in the rollers 8 in the nip. The encoder is coupled to the stepping motor 30 which is thereby synchronised with the motor driving the roller dyes 8. However, in the event that for some reason this synchronism is lost, the incorrect lengthwise alignment of images printed on the ribbon 4 with the recesses in the roller dyes 8 is sensed by the device 28, and the stepping motor is automatically adjusted appropriately to bring them back into synchronism.

The entire transfer station is mounted on a plate 36 which is itself movably mounted on a printer generally indicated 38. When the encapsulating apparatus is initially assembled, the lateral location of the printing roller 20 relative to the adjacent guide roller 16 and hence the ribbon 4 is set by adjustment of wheel 40. Wheel 40 is part of a worm gear mechanism which locates the plate 36 relative to the printer 38, which mechanism also includes a gear box 42. The gear box 42 has its own drive, also adapted to receive signals from the scanning device 28 such that once the encapsulating apparatus is in operation, lateral misalignment of images on the ribbon fall as monitored by the device 28 is compensated. In this respect is should be noted that the lateral shift of the print roller 20 relative to the guide roller 16 will eventually shift the printed images relative to the ribbon 4. The flexibility of the ribbon 4, to which reference is made above, enables such movements to be readily accommodated.

The ink roller 22 is a screened roller, and functions in known manner to transfer ink from the tray 24 to the print roller 20. A doctor blade 44 is used to wipe the screened surface of the inking roller 22 as described above. However, if a smooth surfaced inking roller 22 is used, then a knife can be used in the traditional way to set the weight of ink transferred.

The print roller 20; inking roller 22 and ink tray 24, together with the relevant drive units 30, 32 and 34 are mounted on a common plate 48 which is itself mounted on plate 36 for lateral movement relative to the respective roller axis towards and away from the guide roller 16. A pneumatic cylinder 50 applies a continuous pressure urging the plate 48 and hence the printing roller 20 towards the guide roller 16 and thus determines the pressure at which the printing roller 20 engages the gelatin ribbon 4.

Provision is also made in the apparatus illustrated in FIG. 2 for adjusting the alignment of the print roller 20 and the inking roller 22 to achieve differential inking weights across the axial length thereof. Further, provision may also be made for deliberately inclining the axis of the print roller 20 to the axis of the guide roller 16 to obtain a differential printing pressure on the ribbon along a transverse section thereof. These features can be of value when using different inks for images to be created along a transverse section of ribbon 4.

Figure 3:
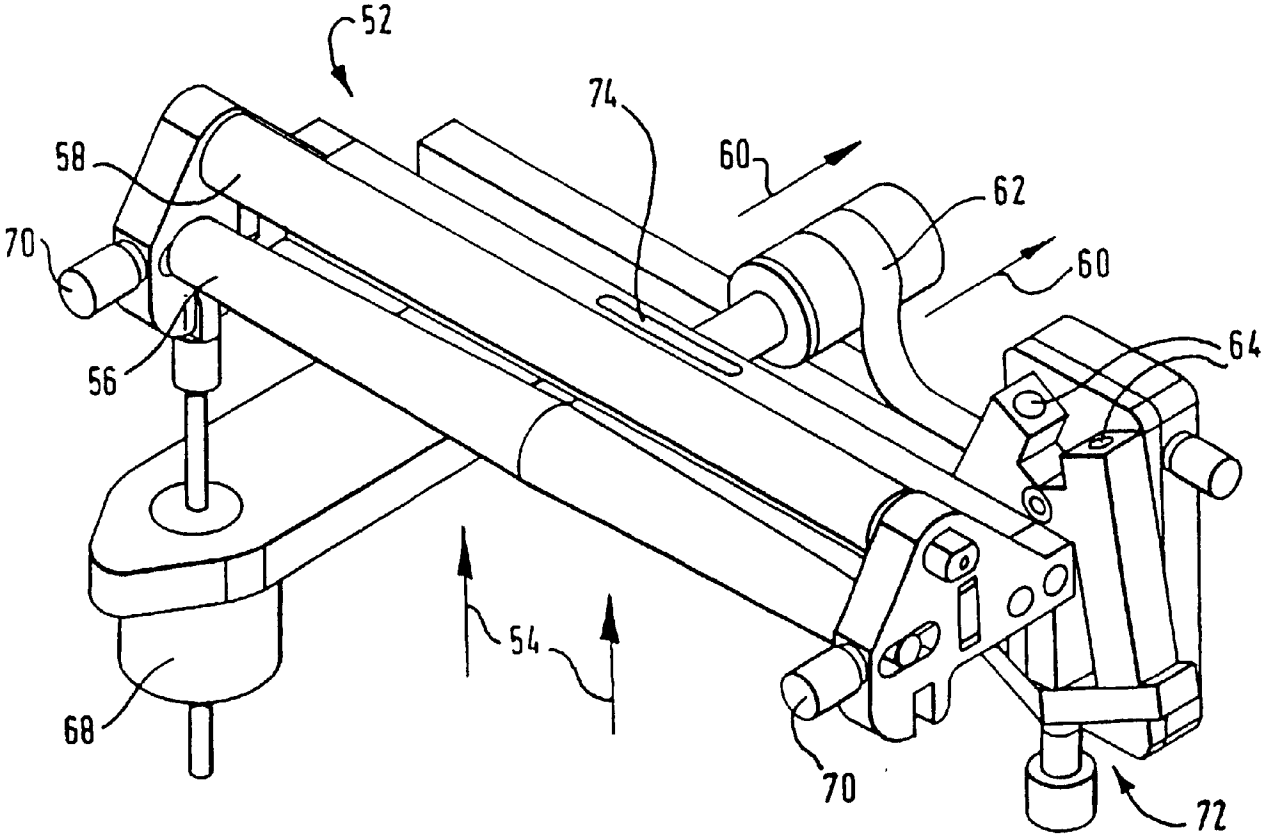
FIG. 3 is a perspective view of an alternative system for monitoring and controlling the gelatin ribbon in accordance with the present invention.

An alternative system for monitoring and controlling the registry of the printed images with the rollers 8 in the encapsulation station is shown in FIG. 3. An applicator guide bar assembly 52 adjusts and sets the lateral alignment of the ribbon prior to its entry into the encapsulation station 6. It can effectively replace not only the sensing device 28, but also one of the rollers 16. The path of the ribbon (not shown in FIG. 3) is upwards as indicated by arrows 54 between front guide 56 and sparge tube 58 mounted on the assembly frame. From the sparge tube 58 the ribbon passes as indicated by arrows 60 over bracket 62 to the final guide roller 16 and thence to the encapsulation station 6. A marginal edge portion of the ribbon passes over two optic sensors 64 which can monitor the position of either the edge of the ribbon, or a marker line thereon applied by a ridge 66 on the print roller 20 at the transfer station. Any lateral movement of the edge or the marker line beyond a predetermined limit is sensed, and in response thereto the axis of the front guide is re-oriented by instruction from a computer (not shown) to guide the edge or marker line back into place. The primary mechanism for accomplishing this is a linear actuator motor 68, adapted to raise or lower one end of the front guide relative to the sparge tube. The guide bar assembly also includes adjusters 70 for initial setting of the front guide when the apparatus is first installed. The optic sensors 64 can themselves be adjusted, both translationally together across the frame, and relative to each other by a mechanism 32 for different ribbon sizes and required accuracy of lateral alignment. The assembly 52 also carries an optic sensor 74 on the frame for monitoring the longitudinal registry of the printed images with the rollers 8 in the encapsulation station 6. Signals for sensor 74 are likewise transmitted to the computer which in turn instructs the stepping motor 30 as required.

The two mechanisms described above for controlling lateral movement of the ribbon enables the apparatus to be operated with much faster movement of the ribbon than was previously possible. By restricting lateral movement of the ribbon to predetermined limits, distortion of the ribbon in its path of movement is minimised, and a substantially uniform tension across the width of the strip can be preserved. As a consequence, not only can the ribbon be moved at greater speed to the encapsulation station, but additionally and/or alternatively a more uniform thickness of gelatin in the ribbon is preserved, enabling in some circumstances the use of a thinner ribbon.

Figure 4:
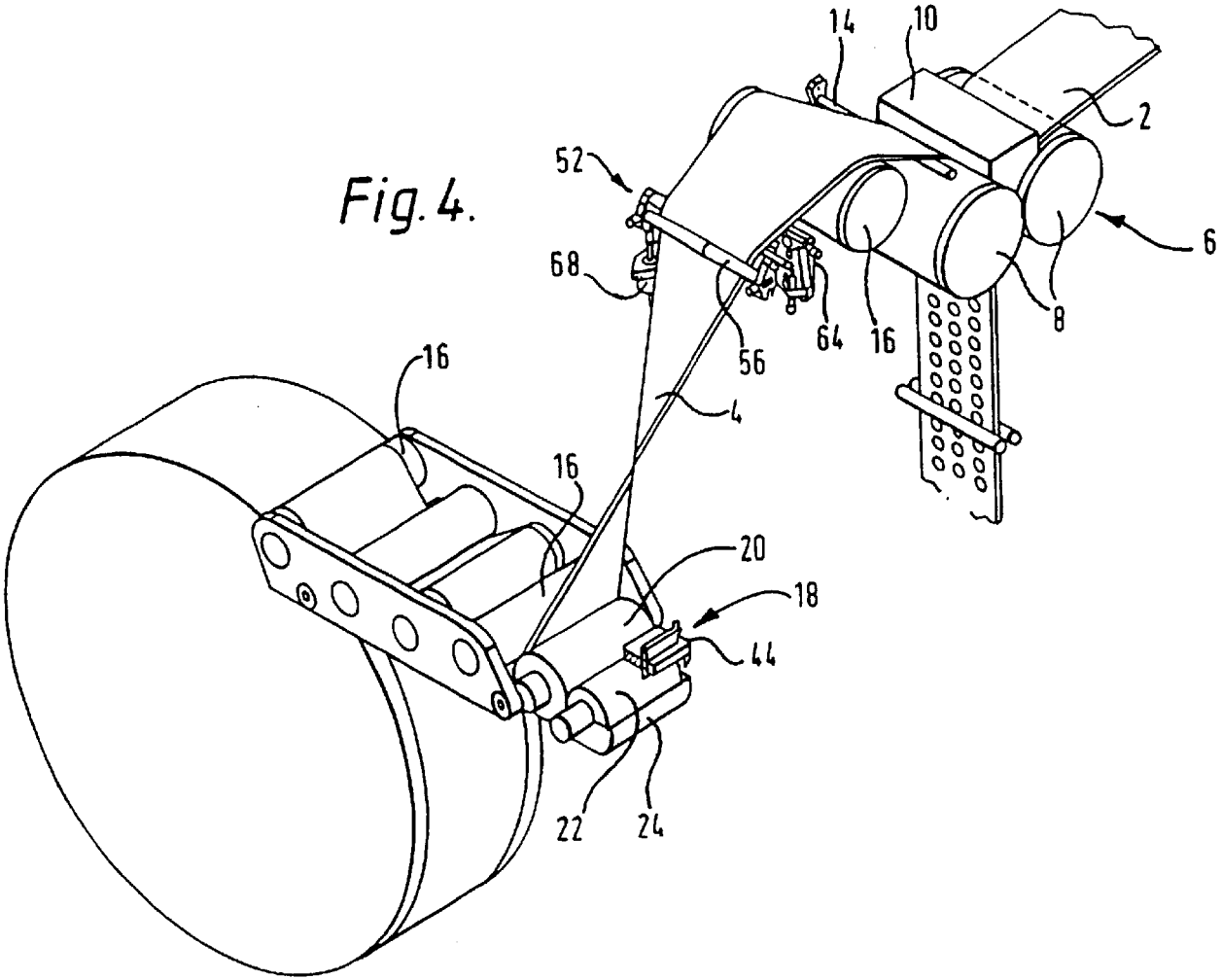
FIG. 4 illustrates apparatus according to the invention which requires the ribbon to twist in its path to the encapsulation station.

For reasons of space, the layout of the elements in a gelatin encapsulating machine would not in practice normally be that shown in FIG. 1. Most significantly, the gelatin casting drums would be turned through 90° to be aligned on substantially the same axis perpendicular to the axes of the rollers 8 in the encapsulation station. This arrangement is illustrated in FIG. 4 which shows the path of ribbon 4, to which images are applied, in apparatus which is fitted with an applicator guide bar assembly 52 of the kind shown in FIG. 3 in place of one of the rollers 16 of FIG. 1. FIG. 4 also shows the train of smoothing and stretching rollers in the path of ribbon from the casting drum to the transfer station 18. As can be seen, the arrangement shown requires the ribbon to twist between the transfer station 18 and the applicator guide bar assembly, which itself increases the importance of monitoring any movement of the imaged ribbon out of registry with the rollers in the encapsulation station, particularly lateral movement.

The path of ribbon 2 from its casting drum to the encapsulation station 6 is essentially a mirror image of that shown in FIG. 4, but omitting the transfer station 18. An applicator guide bar assembly can be included, particularly to monitor lateral movements of the ribbon 2. For the unmarked ribbon of course, the sensors 64 will monitor the position of the ribbon edge only. Longitudinal registry of the ribbon 2 with the encapsulation station does not normally required monitoring.

Figure 5:
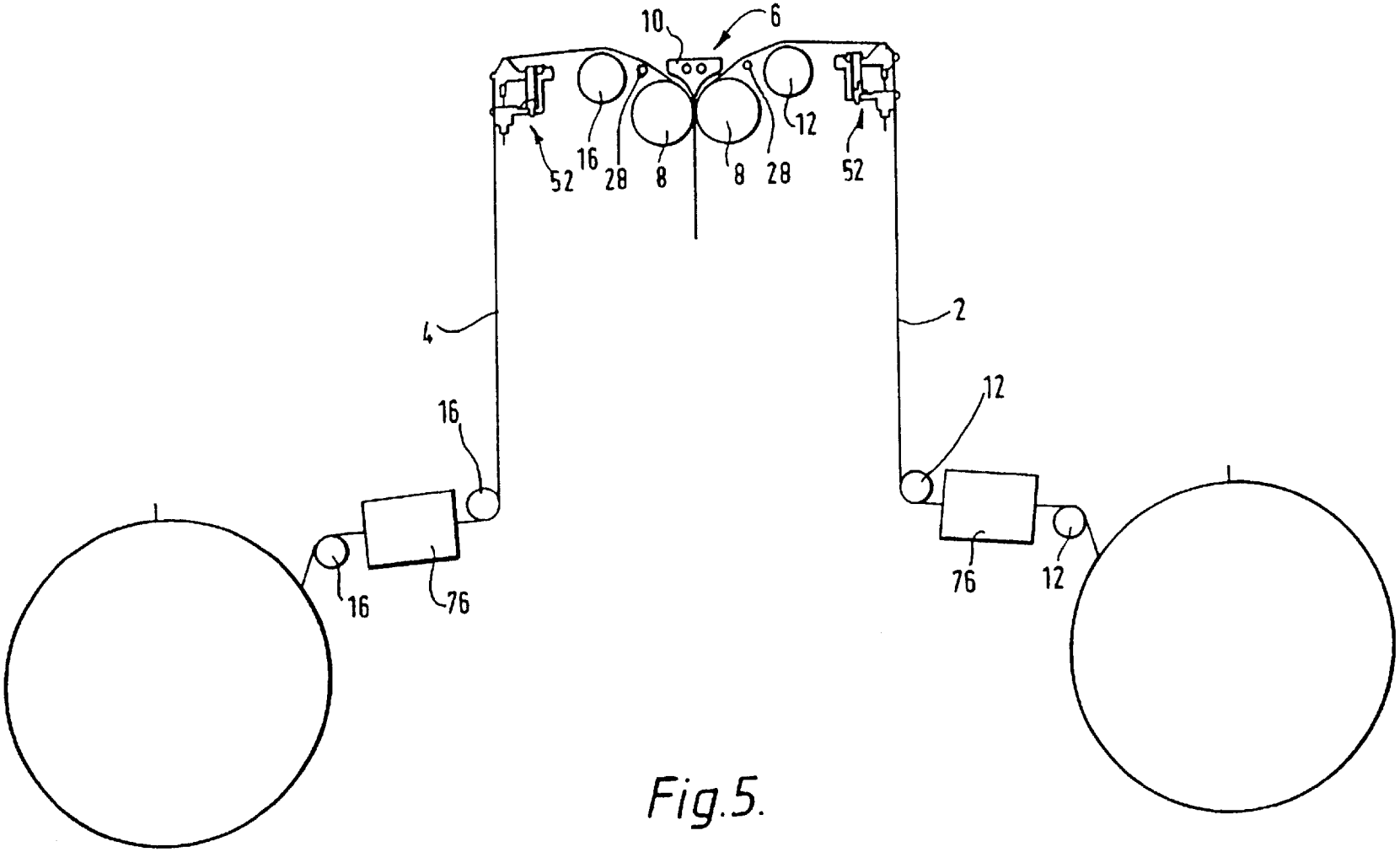
FIG. 5 is a representation of another embodiment of apparatus according to the invention.

The above discussion of the invention describes the apparatus using transfer printing systems. However, the invention is not limited to such systems. Other printing mechanisms may be employed. They could be located between guide rollers in the path of the gelatin strip on its route to the encapsulation station. Thus, in the apparatus described above, the transfer station is effectively replaced by the guide rollers. A preferred alternative printing system is one including an ink jet printer. Ink jet printers can produce clear images on gelatin strips. FIG. 5 illustrates apparatus according to the invention embodying this alternative, and also shows an arrangement in which printing can be applied to both gelatin ribbons, each monitored by an applicator guide bar assembly 52. Ink jet printers 76 are fitted between pairs of rollers 12 and 16 respectively. The other reference numerals in FIG. 5 correspond with those used in the other drawings.

What is claimed is:

1. An apparatus for encapsulating a fill within a shell of gelatin, comprising a motor driven encapsulation station with formation and fill means; a transfer station comprising an inking roller and a print roller driven by a stepping motor; a guidance mechanism for feeding strips of gelatin ribbon into juxtaposition at the encapsulation station; means for drawing the ribbon to the encapsulation station from the source; controlling means for the lateral alignment of at least one of the strips in its path to the encapsulation station comprising a support roller adapted to alter the lateral alignment of the strip and at least one linear actuator motor adapted to raise or lower one end of said support roller; optic sensor means for monitoring the lateral alignment of said strip, said monitoring occurring at the lateral position of an edge of said strip, at a line extending longitudinally on said strip and combinations thereof; a computer for receiving signals from said sensor and instructing said controlling means and for synchronizing said encapsulation station motor and said stepping motor.

2. A method of producing filled gelatin capsules comprising feeding gelatin strips around a transfer station comprising an inking roller and a print roller driven by a stepping motor; feeding said strips around a guidance mechanism into juxtaposition at a motor driven encapsulation station having formation and fill means; monitoring the lateral alignment of the strips in their paths to the encapsulation station through optic sensors, said monitoring occurring at the lateral position of an edge strip, at a line extending longitudinally on said strip and combinations thereof; receiving signals from the sensors at a computer which: (1) instructs a controlling means which comprises at least one support roller in the path of said strips attached to at least one linear actuator motor adapted to raise or lower one end of said support roller adapted to alter the lateral alignment of the strip and (2) synchronizes said encapsulation station motor with said stepping motor.

* * * * *